US006796357B2

(12) United States Patent
Kirby

(10) Patent No.: US 6,796,357 B2
(45) Date of Patent: Sep. 28, 2004

(54) EXTENSION PANEL FOR A FOLDING SHADE

(75) Inventor: David A. Kirby, Emmaus, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 10/260,837

(22) Filed: Sep. 30, 2002

(65) Prior Publication Data

US 2004/0060668 A1 Apr. 1, 2004

(51) Int. Cl.[7] ..... E06B 9/24
(52) U.S. Cl. ..... 160/84.06; 160/40
(58) Field of Search ..... 160/45, 61, 62, 160/76, 81, 83.1, 40, 209, 84.01, 84.02, 84.06, 84.08, 352; 52/63, 222

(56) References Cited

U.S. PATENT DOCUMENTS 1,813,017 A * 7/1931 Bond ..... 49/87.1
2,187,639 A * 1/1940 Bond ..... 49/82.1
3,564,784 A * 2/1971 Mollinger ..... 52/63
4,062,146 A * 12/1977 Grossman et al. ..... 47/17
4,683,933 A * 8/1987 Dunbar ..... 160/273.1
5,931,212 A * 8/1999 Mullet et al. ..... 160/188
6,079,472 A * 6/2000 Schanz ..... 160/265
6,094,779 A * 8/2000 Young ..... 16/92
6,119,755 A * 9/2000 Oskam ..... 160/84.02

FOREIGN PATENT DOCUMENTS

EP 0322534 * 10/1988

* cited by examiner

*Primary Examiner*—Blair M. Johnson
(74) *Attorney, Agent, or Firm*—Drinker Biddle & Reath LLP

(57) ABSTRACT

A shade system includes a plurality of panels that are supported by opposite first and second tracks for translation of the panels between retracted and extended positions. The shade system further includes an extension panel supported for translation with a terminal shade panel. An extension panel support assembly includes mount members translatably secured to the tracks and deployment members that position at least a portion of the extension panel beyond an end of the tracks when the shade system is in the extended position. A drive system engages the deployment members to translate the extension panel with respect to the tracks and to deploy the extension panel beyond the end of the tracks.

21 Claims, 7 Drawing Sheets

EXTENSION PANEL FOR A FOLDING SHADE

FIELD OF THE INVENTION

The invention relates generally to window shades, particularly folding shades having flexible panels supported for translation with respect to opposite curved tracks.

BACKGROUND OF THE INVENTION

Convention centers, museums and other public structures, are often designed to include large sections of glass, or other light-transmissive material, in the exterior walls or the ceiling to admit as much natural light as possible into the structure. Such structures often include portions of walls or ceilings that are obliquely angled with respect to grade to optimize admission of light or simply for reasons of aesthetic design. The portions of the structure can also be curved. It is often necessary or desirable to shade such sections from direct sunlight, or for privacy or other reasons. For such structures, a folding shade system is useful for shading of the angled portions of the structure.

A folding shade system includes a multiple-paneled shade supported by rods or cables engaging the shade between adjacent panels. The rods or cables are attached to cars that translate along tracks located on opposite sides of the shade. Motor driven pull cables are attached to an end of the shade to provide for lowering and raising of the shade on the tracks.

The engagement between the tracks and the cars establishes upper and lower boundaries for potential translation of the shade along the tracks by the motor driven pull cables. Areas beyond the upper end of the tracks cannot be covered by prior art folding shade systems because the cars are of necessity stopped before the end of the tracks are reached to maintain the engagement between the cars and the tracks. Thus, in situations where the track cannot be extended to reach certain areas, because of structural constraints for example, a prior art folding shade cannot be used to cover such an area, or can only cover a portion of the area with gaps remaining between the shade and the structure.

SUMMARY OF THE INVENTION

The present invention provides a shade system including a plurality of shade panels secured together in an end-to-end fashion. The shade panels are supported for translation along first and second tracks between a retracted position in which the shade panels are located adjacent a first end of the tracks and an extended position in which the shade panels extend toward an opposite second end of the tracks. The shade system further includes an extension panel operably connected to a terminal shade panel for translation therewith.

The shade system includes an extension panel support assembly having respective first and second mount members operably secured to the first and second tracks for translation therealong. The extension panel support assembly further includes respective first and second deployment members connected to the first and second mount members. The deployment members are secured to the extension panel and adapted to place at least a portion of the extension panel beyond the second end of the tracks when the shade system is in the extended position.

The shade system also includes a drive system engaging at least one of the deployment members. The drive system is adapted to translate the extension panel and the shade panels between the retracted and the extended positions.

According to one embodiment of the invention, the deployment member includes an elongated arm that is pivotably connected to the mount member at a pivot axis. The pivot axis is substantially perpendicular to a portion of the track adjacent the mount member such that the arm is pivotable between a retracted position in which the arm is oblique with respect to the adjacent track portion and a deployed position in which the arm is substantially parallel the adjacent track portion.

DETAILED DESCRIPTION OF THE PREFERRED EMBODIMENTS

Figure 1A:
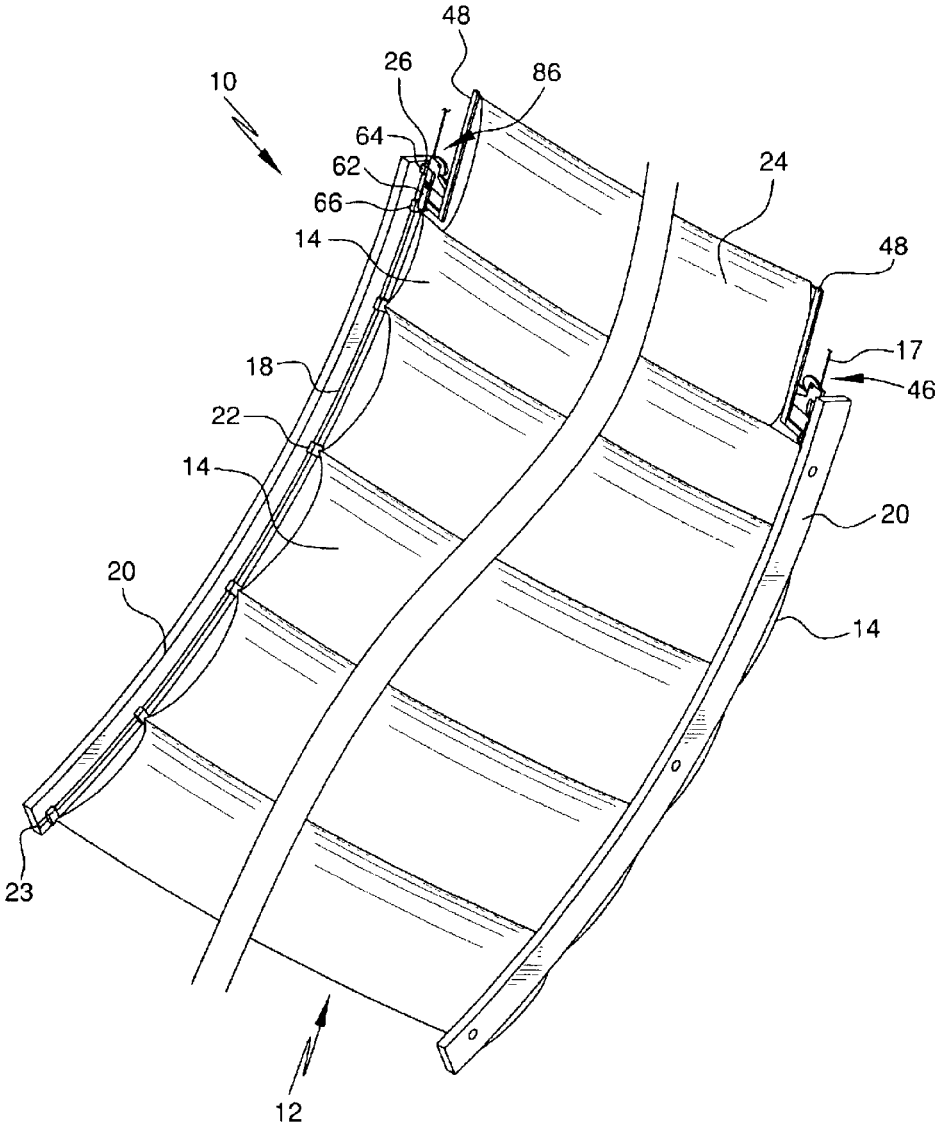
FIGS. 1A–1C are perspective views of the folding shade system of FIG. 1 respectively illustrating a fully closed shade, a partially open shade, and a fully open shade.
Figure 1B:
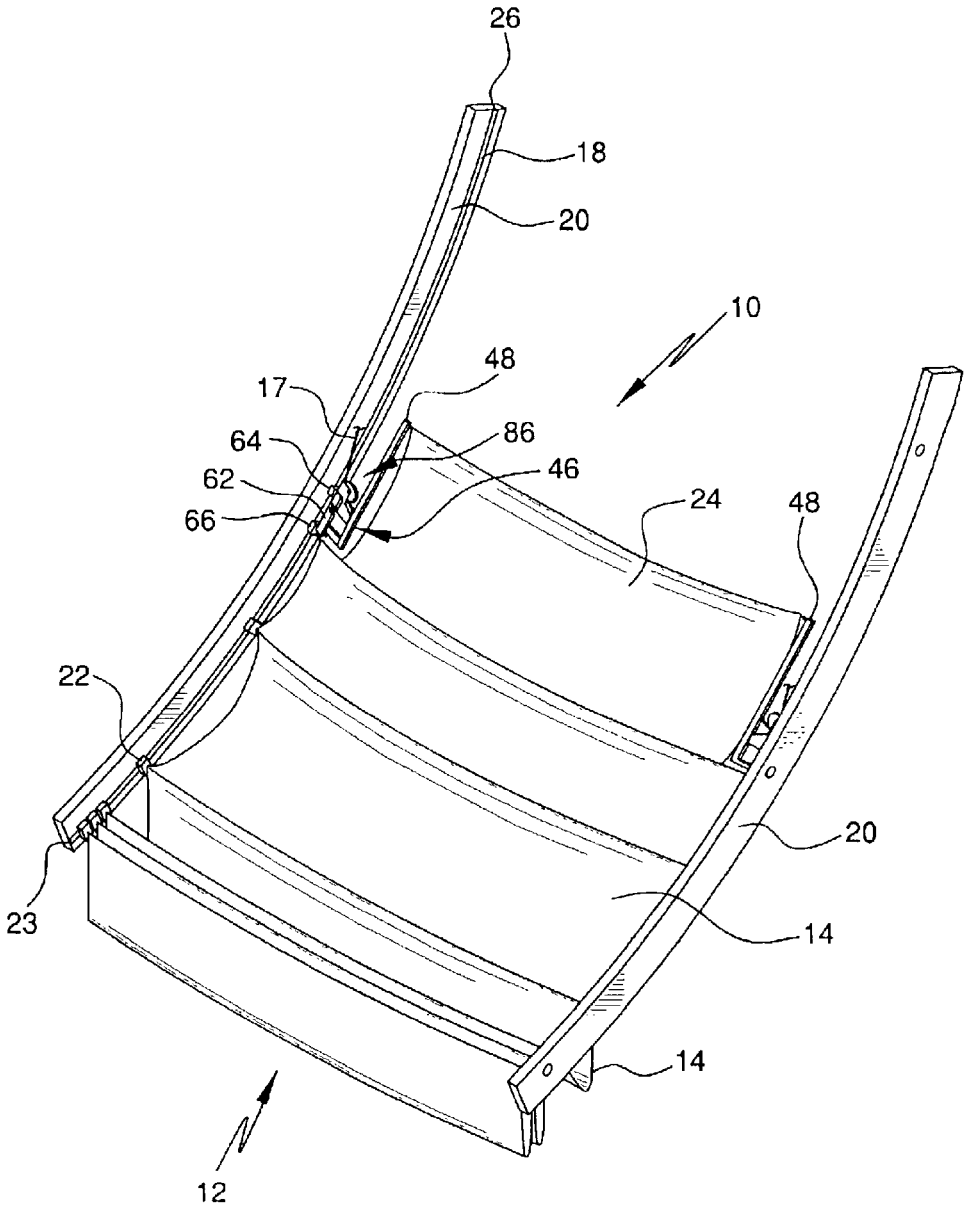
Figure 1C:
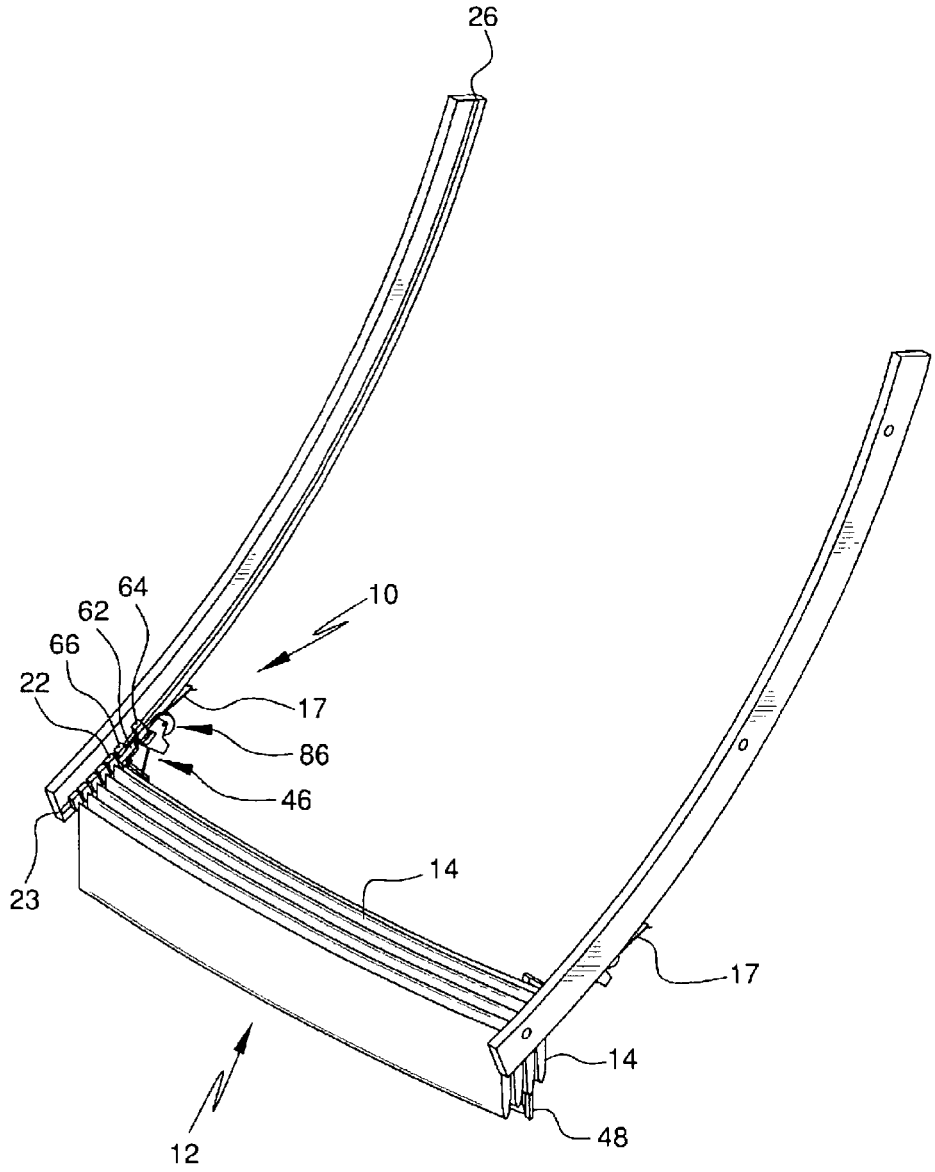
Figure 1:
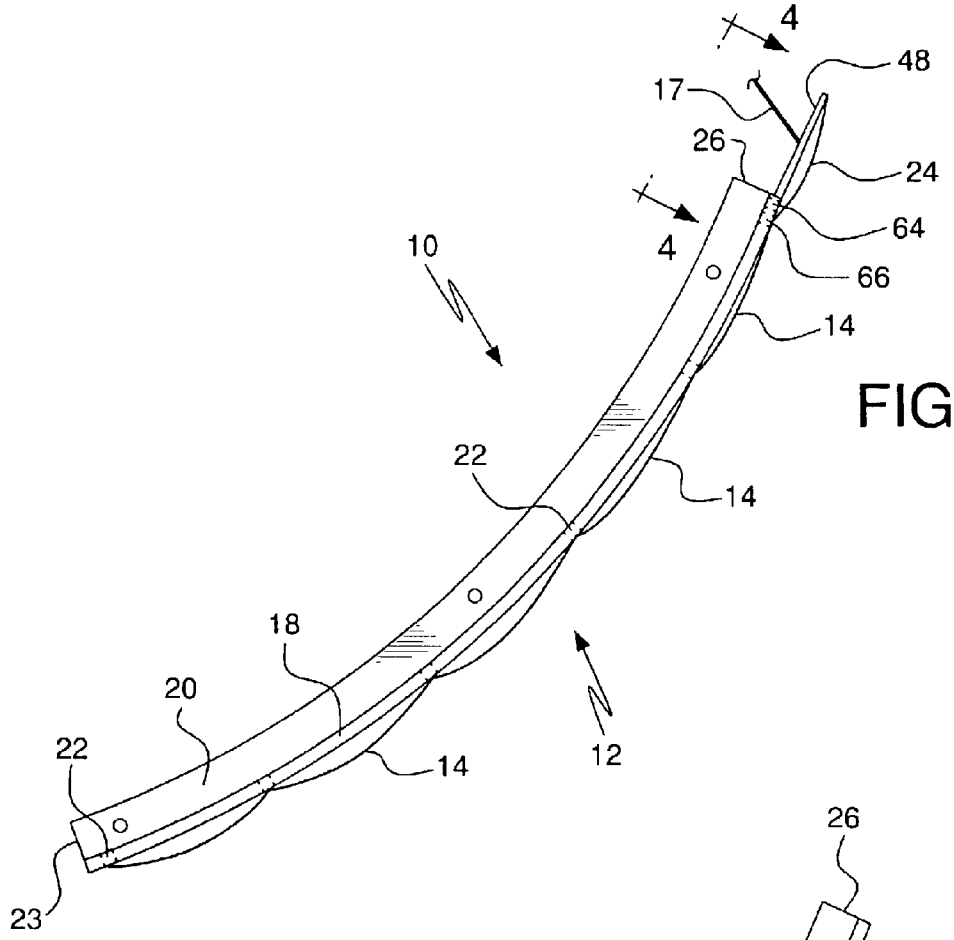
FIG. 1 is a side view of a folding shade system according to the invention illustrating the shade raised to a closed position.
Figure 2:
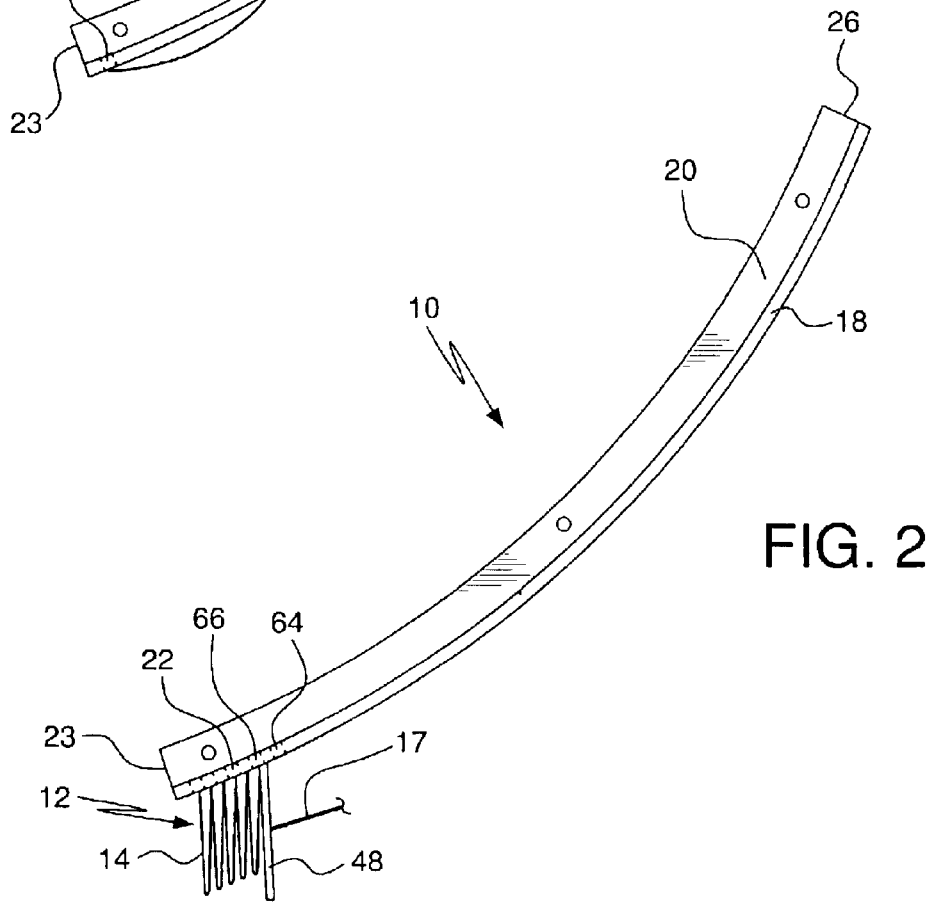
FIG. 2 is a side view of the folding shade system of FIG. 1 showing the shade lowered to an open position.

Referring to the drawings, where like numerals identify like elements, there is illustrated a folding shade system 10 according to the present invention. Referring to FIGS. 1–2, the system 10 includes a shade 12 having a plurality of panels 14 secured together in an end-to-end fashion. The system 10 includes cables 16 (FIG. 3) that engage the shade 12 at the junctures between adjacent panels 14. The cables 16 extend across the width of the shade panels 14 between opposite sides of the shade 12 for support of the shade 12 on opposing curved tracks 18, shown in FIGS. 1A–1C. The tracks 18 are secured to supports 20 that are, in turn, secured to the walls or ceiling (not shown) of a structure. Only one of the tracks 18 is visible in the side views shown in FIGS. 1 and 2, it being understood that the opposite track would appear as a mirror image in an opposite side view of the shade system 10.

The folding shade system 10 includes cable-supporting cars 22 that engage the tracks 18 for translation thereto in the manner to be described below. Each of the opposite ends of a cable 16 is secured to one of oppositely located cars 22 carried by the tracks 18. The folding shade 12 is shown in FIGS. 1 and 1A in a raised and closed position. The shade system 10 includes motor-driven pull cables 17 of a shade drive system attached to the shade 12 to provide for the lowering of the shade 12 to the partially open position shown in FIG. 1B and the fully open position shown in FIGS. 1C and 2. As shown in FIG. 2, as the cable-supporting cars 22 approach the bottom of the tracks 18, the panels 14 of the shade 12 fold lengthwise approximately in half.

The folding shade system 10 includes an extension panel 24 secured to the shade 12 at an upper end thereof. As shown in FIGS. 1 and 1A, the extension panel 24 of the shade 12 provides for coverage by the shade 12 of an area beyond an upper end 26 of the tracks 18. Prior art folding shade cannot provide coverage of an area that is not reached by the tracks because of the engagement that must be maintained between the cables 16 and the track 18.

Figure 3:
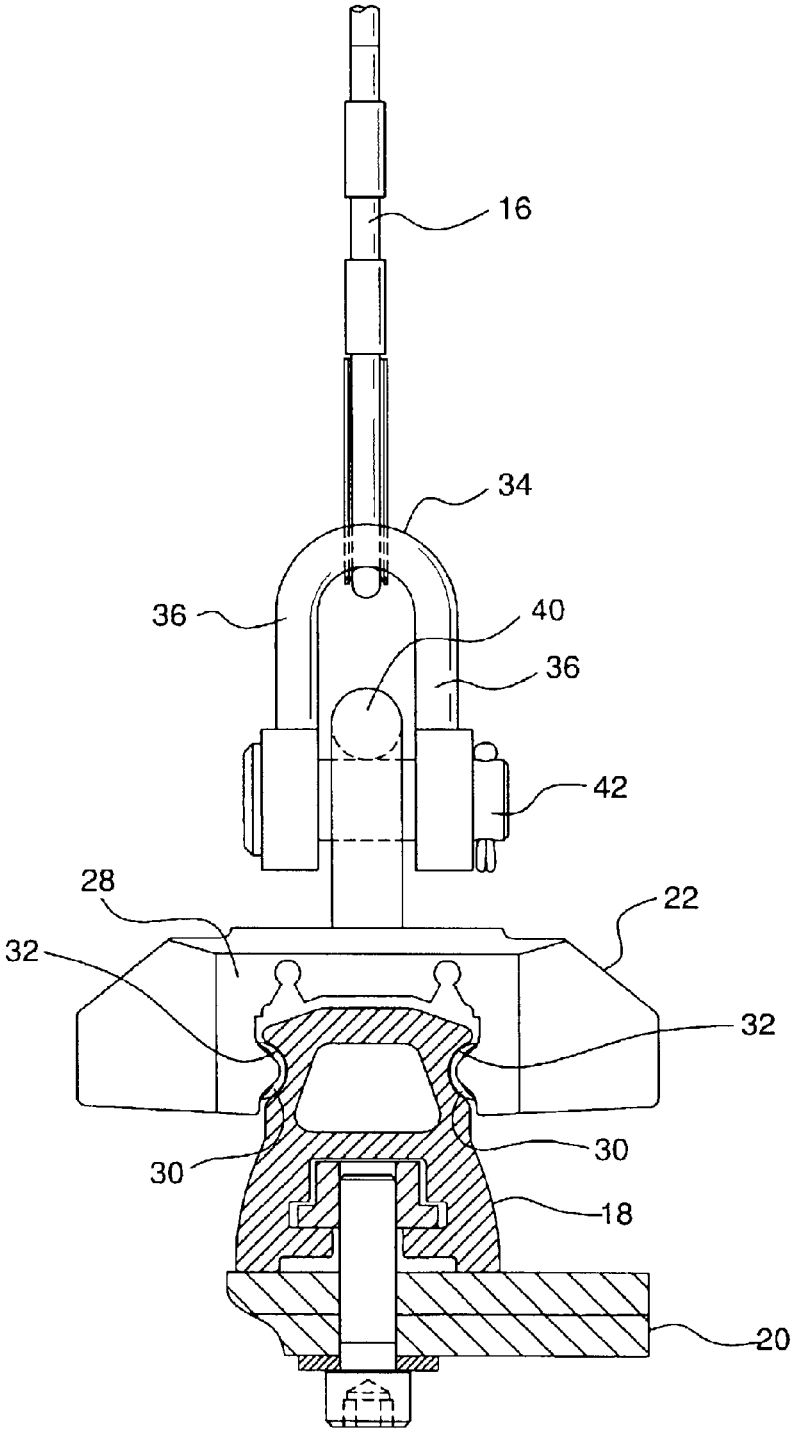
FIG. 3 is a end view, partly in section, of a cable car of the shade system of FIGS. 1 and 2 engaging one of the tracks.

Referring to FIG. 3, the connection between the cables 16 and the cars 22 and between the cars 22 and the tracks 18 is shown. Each of the cars 22 has a body 28 that rotatably supports wheels 30 or other suitable roller members. The cars 22 are mounted on the tracks 18 such that the wheels 30 are received in notches 32 formed on opposite sides of the tracks 18 for rolling support of the cars 22. A clevis 34 having opposite arms 36 is secured to the ends 38 of the cables 16 to provide for attachment of the cables 16 to the cars 22 as follows. Each of the cars 22 includes a loop 40 secured to body 28 of the car 22. A pin 42 is received through the arms 36 of the clevis 34 such that the pin 42 extends through the loop 40 of the car 22. The connection of the cables 16 to the cars 22 in this manner provides a releasable connection that facilitates removal of the shade 12 from the track 18 for repair or maintenance for example. The invention, however, is not limited to the clevis and pin connection shown in FIG. 3. Any suitable form of connection could be used to secure the ends of the cables 16 to the cars 22.

Figure 4:
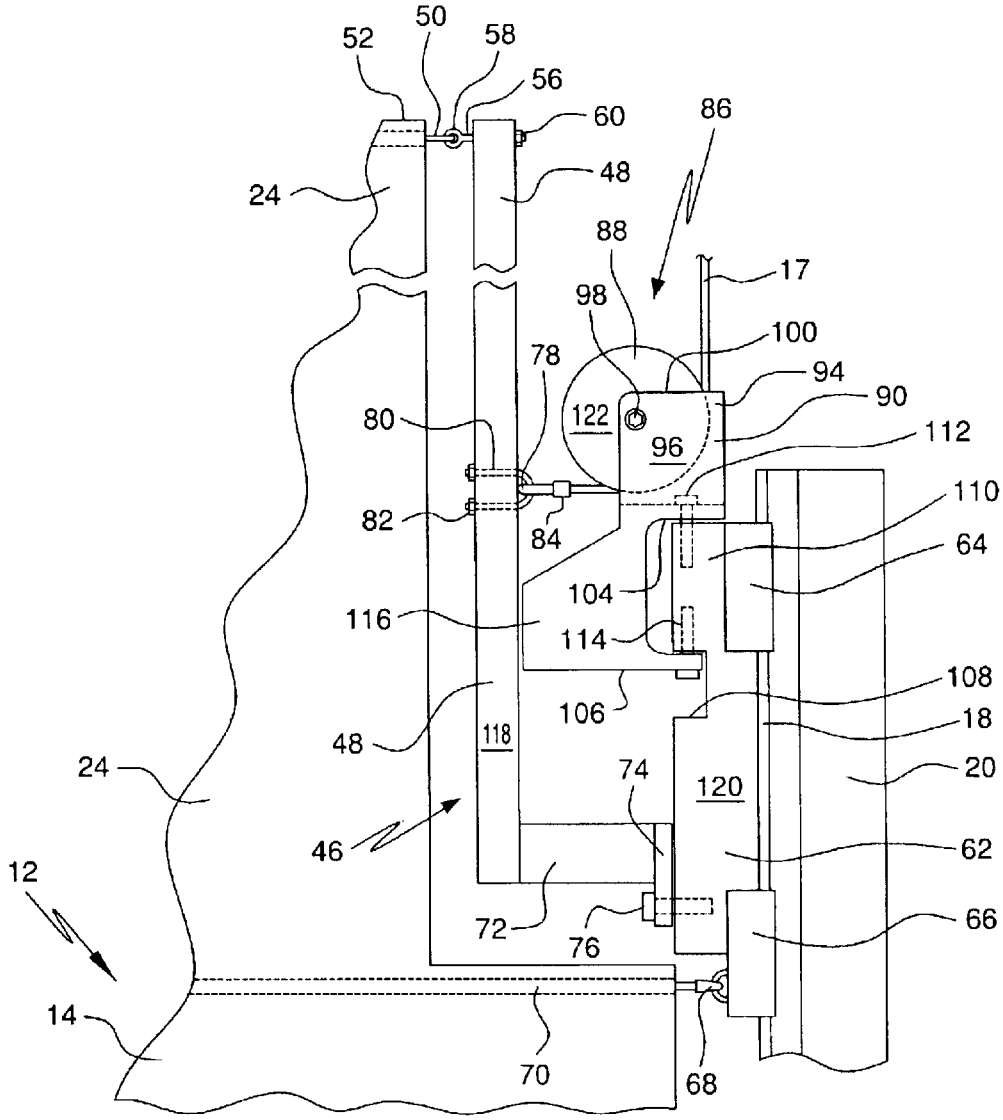
FIG. 4 is a partial front view of the folding shade system of FIG. 1 showing the extension panel elevating system.
Figure 5:
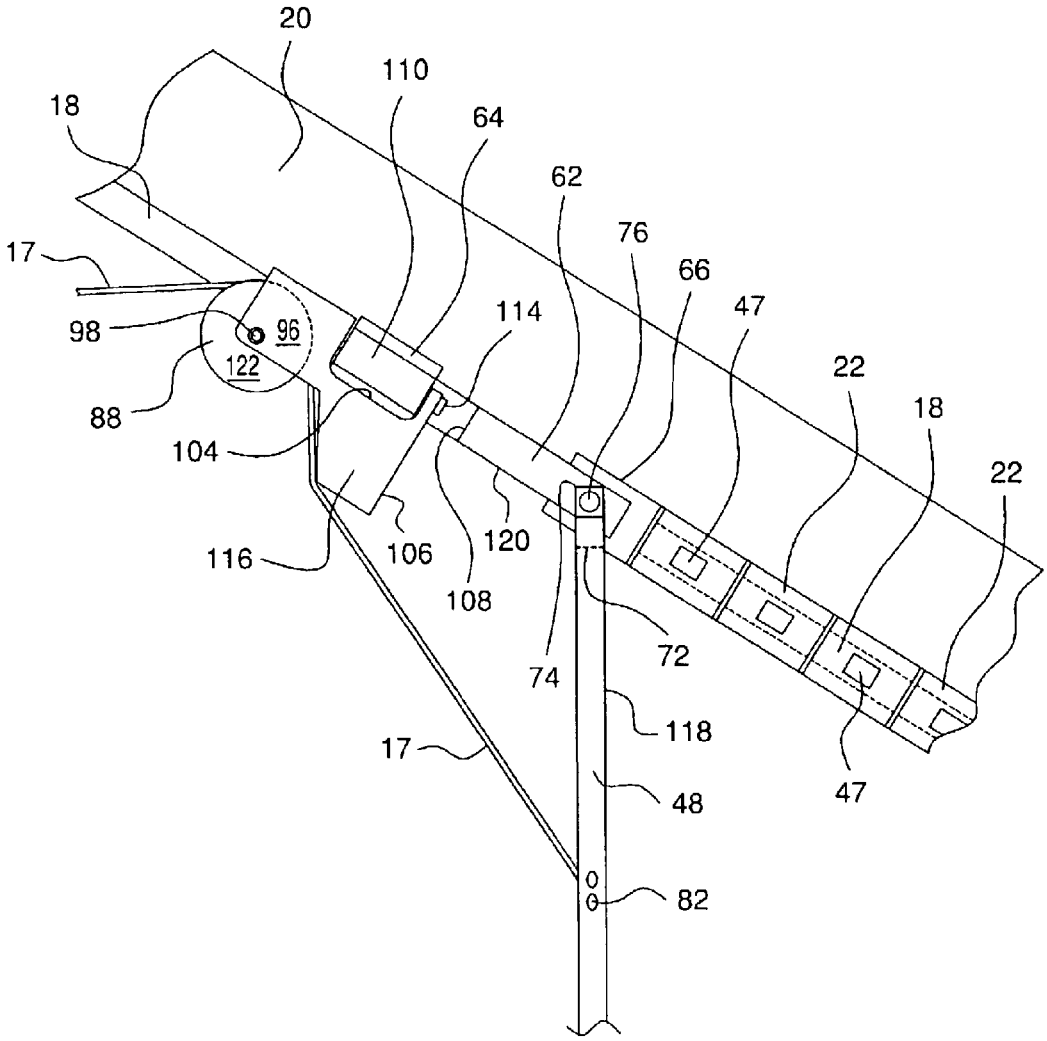
FIG. 5 is a partial side view of a folding shade in a lowered position with the shade and supporting cables removed for clarity of view.

Referring to FIGS. 4 and 5, the folding shade system 10 includes an extension panel support assembly 46. The support assembly 46 functions to connect the extension panel 24 to the tracks 18. The support assembly 46, in the manner to be described, also functions to vary the orientation of the extension panel 24 with respect to the tracks 18 between a down and stored position shown in FIGS. 1C, 2 and 5 (oblique to track) and a deployed position shown in FIGS. 1, 1A and 4 (parallel to track). The shade system 10 has been shown in FIG. 5 with the panels 14 and cables 16 removed for clarity. The connection between the cable 16 and the cars 22 is shown schematically in FIG. 5 as 47.

The support assembly 46 includes elongated support arms 48 attached to opposite sides of the extension panel 24. As shown in FIG. 4, the extension panel 24 receives a panel support cable 50 adjacent an end 52 of the panel. Each end of the cable 50 is, in turn, secured to one of the support arms 48 adjacent an end 54 of the support arm. The cable 50 is secured to a loop portion 58 of a connector 56 that is received by the support arm 48 and fastened thereto by nut 60. The cable 50 could, alternatively, be connected to the support arm 48 using a releasable connection similar to the connection shown in FIG. 3 between the cables 16 and the cars 22, for example.

The panel support arms 48 of assembly 46 are supported for translation with respect to the tracks 18 as follows. Each of the panel support arms 48 is connected to an elongated mount member 62 supported by spaced apart cars 64 and 66. Each of cars 64, 66 engages one of the tracks 18 as described above to provide for translation of the extension panel 24 along the tracks. The mount member 62 is secured to each of the cars 64, 66 of the assembly 46, preferably using fasteners (not shown). The connection of the mount member 62 to cars 64, 66 fixes the spacing between the cars. As shown in FIG. 4, a connector 68 secures cable 70 extending between the extension panel 24 and a last panel 14 of shade 12 to car 66 of assembly 46. Positioned in this manner, the mount members 62 and the cars 64, 66 function as lead carriers supporting the panel support arms 48 for deployment of the extension panel 24 when the mount members 62 reach the end of the tracks 18.

A bar 72 is secured to each of the support arms 48, preferably by welding. The bar 72 extends perpendicular to the support arm 48 and functions to space the support arm 48 at a distance from the mount member 62. The spacing of the support arm 48 from the mount members 62 provides clearance between the support arms 48, which are supported for pivot with respect to the mount members 62, and structure (described below) for connecting the pull cables 17 of a shade drive system to the support arms. A plate 74, secured to each bar 72 opposite the respective support arm 48, is pivotably connected to the mount member 62 by a bolted connection 76. The pivotable connection between the plate 74 and the mount member 62 provides for pivoting of the support arms 48 with respect to the tracks 18. The pivoting of the support arms 48 provides for variation in the orientation of the extension panel 24 with respect to tracks 18 between a deployed position in which panel 24 is substantially parallel to an adjacent portion of the curved tracks 18 and a stored position.

As shown in FIGS. 1, 1A and 4, when the extension panel 24 is in the deployed position, each of the support arms 48 is oriented substantially parallel with respect to the mount member 62. The arms are, therefore, substantially parallel to a tangent to the curved tracks 18 taken at the location of the mount member 62. As shown in FIGS. 2 and 5, as the mount members 62 approach the lower end of the tracks 18, the support arms 48 pivot with respect to the mount members 62. The pivoting of the support arms 48 lowers the arms to an angled position with respect to mount member 62 and a tangent line to the track 18.

Referring again to FIG. 4, each of the motor-driven pull cables 17 is secured to one of the support arms 48 at 78 to provide for translation of the shade 12 along the tracks 18. A substantially U-shaped member 80 is received by the support arm 48 and secured thereto by threaded nuts 82. A cable connector 84 secures the pull cable 17 to a loop defined by the U-shaped member 80 to secure the pull cable 17 to the support arm 48.

The extension panel support assembly 46 further includes pull cable guides 86 having a pulley 88 rotatably supported by a pulley support 90. The spacing between the pivoting support arms 48 and the mount members 62, provided by bar 72, accommodates the pull cable guide 86 as shown in FIG. 4. The engagement between the pull cables 17 and the pull cable guides 86 facilitates the dual functioning of the pull cables 17, which provide for both raising and lowering of the shade 12 on tracks 18 and pivoting of the extension panel 24 between deployed and stored orientations.

The pulley support 90 of the pull cable guide 86 includes a first end portion 94 having spaced plates 96. The pulley 88 is received by the first end portion 94 between plates 96 and is secured thereto by pin 98 adjacent end 100 such that a portion of the pulley 88 extends from the pulley support 90. Only one of the plates 96 is visible in FIG. 4, it being understood that the other plate would appear as a mirror image in an opposite view. The pulley 88 preferably includes a recess (not visible) in peripheral surface 102 in which the pull cable 17 is received.

The pulley support 90 of the pull cable guide 86 includes a notch 104 adjacent an end 106 of the support opposite the pulley 88. The mount member 62 includes an end portion 110 dimensioned for receipt within the notch 104 of the pulley support 90. The pulley support 90 is pivotably secured to the end portion 110 of mount member 62 by bolts 112, 114 received through openings in the pulley supports adjacent opposite sides of the notch 104 to engage the end portion 110 of the mount member 62. A recess 108 in mount member 62 is dimensioned to provide for connection of bolt 114 to the mount member.

As shown in FIG. 4, a portion 116 of the pulley support 90 adjacent end 106 and opposite notch 104 is dimensioned to provide for clearance between the panel support arm 48 and the pulley support 90 when the support arm 48 is pivoted to the deployed position. The clearance provided between the support arm 48 and portion 116, however, is limited. The portion 116 functions as a stop to limit lateral deflection of the support arms 48 (toward the tracks 18 in FIG. 4) caused by forces applied to the support arms 48 by the pull cables 17 after the support arms have been pivoted to the deployed position shown in FIG. 4.

The pivotable connection of the pulley support 90 to the mount member 62 in this manner facilitates the lowering of the extension panel 24 to the stored position as follows. In the up and deployed position shown in FIG. 4, support arm 48 is oriented with respect to mount member 62 such that location 78 on support arm 48 is positioned adjacent to pulley 88. In this position, surface 118 of support arm 48 is substantially parallel to surface 120 of mount member 62 and, therefore, substantially parallel to an adjacent portion of the tracks 18. As shown in FIG. 4, this position of the support arm 48 orients the pull cable guide 86 such that side surface 122 of the pulley 88 is also substantially parallel to surface 120 of mount member 62. The pivot axis of pulley 88 defined by the pin 98 is, therefore, substantially perpendicular to the pivot axis for the support arm 48 defined by the bolted connection 76 of plate 74.

When the mount member 62 approaches the lower end of the tracks 18, the weight of the support arms 48 and the extension panel 24 will cause each support arms 48 to pivot about the axis defined by bolted connection 76. The pivot of the support arms 48 with respect to the mount members 62 positions the support arms 48 and the attached extension panel 24 next to the other panels 14 of the shade 12 folded at the lower end of the tracks 18 as shown in FIG. 2. In this position the support arms 48 are oriented obliquely with respect to the surface 120 of mount member 62 and an adjacent portion of the track 18. With respect to the point of view shown in FIG. 4, location 78 on support arm 48 will describe an arc in a vertical plane that is substantially perpendicular to the plane containing side surface 122 of pulley 88. The connection of the pulley support 90 to the mount member 62 allows the cable guide 86 to pivot about a vertical axis. This orients the pulley 88 to the pull cable 17 as the arc described by location 78 takes the end of pull cable 17 away from the plane in which side surface 122 of pulley 88 was located in the deployed position of FIG. 4.

The specific length of the extension panel 24 is not critical to the invention. The length of the support arms 48 and extension panel 24 may, therefore, be varied from that which is shown in the figures depending on the particular requirements of a given site for which coverage by a folding shade according to the invention is desired.

The present invention is also not limited to the specific construction of the support arm shown in the figures. It is conceivable, for example, that each support arm could include a terminal end portion that angles inwardly with respect to the extension panel toward the other support arm. Such a construction, functioning to limit sag of the terminal end of the extension panel, could be desired for folding shades having very wide panels.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A shade system comprising:

a plurality of shade panels secured together in an end-to-end fashion;

first and second tracks oppositely located with respect to each other, the shade panels being supported for translation along the tracks between a retracted position in which each of the shade panels is located adjacent a first end of the tracks and an extended position in which the shade panels extend toward an opposite second end of the tracks;

an extension panel operably connected to a terminal one of the shade panels for translation therewith;

an extension panel support assembly including respective first and second mount members operably secured to the first and second tracks for translation therealong, the extension panel support assembly further including respective first and second deployment members connected to the first and second mount members, the deployment members adapted to lift the extension panel with respect to the mount members into a deployed position such that at least a portion of the extension panel extends beyond the second end of the tracks when the shade system is in the extended position; and a drive system engaging at least one of the deployment members, the drive system adapted to translate the extension panel and the shade panels between the retracted position and the extended position.

2. The shade system according to claim 1 further comprising a plurality of cables extending between the first and second tracks, each of the shade panels supported by at least one of the cables.

3. The shade system according to claim 2 further comprising a plurality of cars including at least one roller member rotatably supported by the car, each of the roller members adapted to engage a notch formed on one of the first and second tracks, each of the cars further adapted for attachment between the car and an end of one of the cables.

4. The shade system according to claim 1, wherein each of the mount members is secured to at least one car having at least one roller member, the roller member adapted to engage a notch formed in the respective one of the first and second tracks for translation of the mount members with respect to the tracks.

5. The shade system according to claim 4, wherein the first and second mount members is secured to first and second cars, the first and second cars respectively located adjacent opposite first and second ends of the mount member.

6. The shade system according to claim 1, wherein each of the first and second deployment members includes an elongated arm pivotably connected to a respective one of the first and second mount members at a first pivot axis, the first pivot axis oriented substantially perpendicularly to a portion of the track adjacent the mount member such that the arm is pivotable between a deployed position in which the arm is substantially parallel to the adjacent portion of the track and a stored position.

7. The shade system according to claim 6, wherein the drive system includes a drive cable attached to the elongated arm of at least one of the deployment members, the drive cable attached to the arm at a distance from the first pivot axis whereby movement of the drive cable causes the arm to pivot between the stored and deployed positions and to translate the shade panels between the retracted and extended positions.

8. The shade system according to claim 7, further comprising a drive cable guide assembly for each of the drive cables, the guide assembly including a pulley rotatably supported by a pulley support member secured to the mount member for receipt of the respective pull cable.

9. A shade system comprising:

a plurality of shade panels secured together in an end-to-end fashion;

first and second tracks oppositely located with respect to each other, the shade panels being supported for translation along the tracks between a retracted position in which each of the shade panels are located adjacent a first end of the tracks and an extended position in which the shade panels extend toward an opposite second end of the tracks;

an extension panel operably connected to a terminal one of the shade panels for translation therewith;

an extension panel support assembly including respective first and second mount members operably secured to the first and second tracks for translation therealong, the support assembly further including respective first and second deployment members connected to the first and second mount members, the deployment members adapted to place at least a portion of the extension panel beyond the second end of the tracks when the shade system is in the extended position, each of the first and second deployment members including an elongated arm pivotably connected to a respective one of the first and second mount members at a first pivot axis, the first pivot axis oriented substantially perpendicular to a portion of the track adjacent the mount member such that the arm is pivotable between a deployed position in which the arm is substantially parallel to the adjacent portion of the track and a stored position;

a drive system engaging at least one of the deployment members, the drive system adapted to translate the extension panel and the shade panels between the retracted position and the extended position, the drive system including a drive cable attached to the elongated arm of at least one of the deployment members, the drive cable attached to the arm at a distance from the first pivot axis whereby movement of the drive cable causes the arm to pivot between the stored and deployed positions and to translate the shade panels between the retracted and extended positions; and a drive cable guide assembly for each of the drive cables, the guide assembly including a pully rotatably supported by a pulley support member secured to the mount member for receipt of the respective pull cable, the pulley support member pivotably secured to the mount member for pivot about a second pivot axis, the second pivot axis being substantially parallel to the adjacent track portion, the deployment member associated with the guide assembly including a spacing member extending substantially perpendicularly with respect to the adjacent track portion, the spacing member located between the arm and the mount members such that the arm is spaced from the mount member to accommodate a pivoting pulley support member.

10. The shade assembly according to claim 9, wherein the mount member associated with the guide assembly includes a notched portion located intermediately between opposite first and second ends thereof and wherein the pulley support member associated with the guide assembly includes a notched portion located intermediately between opposite first and second ends thereof, the notched portion of the pulley support member adapted for receipt of an end portion of the mount member defined by the notched portion of the mount member.

11. A window shade apparatus comprising:

first and second spaced tracks;

a plurality of flexible shade panels arranged in an end-to-end relationship, the panels suspended between the tracks and translatable thereto in a direction substantially parallel to the tracks between a fully retracted position and a fully extended position;

an extension panel assembly including an extension panel connected to a terminal one of the shade panels, the extension panel assembly further including a pair of mount members each translatably connected to one of the tracks; and means for deploying the extension panel into a deployed position, the means for deploying the extension panel lifting the extension panel with respect to the mount members to place the extension panel in the deployed position such that the extension panel extends beyond an end of the tracks when the window shade is in the fully extended position.

12. The window shade apparatus according to claim 11, wherein the means for deploying the extension panel includes first and second spaced arms, the extension panel supported between the arms, the means for deploying further including a drive cable secured to at least one of the arms for translation of the extension panel and the shade panels between the fully retracted position and the fully extended position.

13. The window shade apparatus according to claim 12 further comprising:

a lead carrier assembly coupled to each of the first and second tracks for translation with respect to the respective track, each lead carrier assembly having a leading end and a trailing end, each of the arms being pivotably connected to the respective lead car assembly at a pivot axis for pivot of the extension panel with respect to the lead carrier assemblies, the drive cable being secured to the associated arm at a distance from the pivot axis for pivot of the extension panel by the drive cable.

14. The window shade apparatus according to claim 13 further comprising:

a drive cable guide assembly for each of the drive cables including a pulley rotatably supported by a pulley support member and receiving the drive cable, the pulley support member being secured to the associated lead carrier assembly.

15. The window shade apparatus according to claim 14 wherein the pulley support member is pivotably secured to the lead carrier assembly to facilitate pivot of the associated arm with respect to the lead carrier assembly.

16. A system for covering a window comprising:

a shade having a plurality of panels arranged in an end-to-end fashion;

a pair of spaced tracks having opposite first and second ends, the shade supported between the tracks such that at least a portion of the shade is translatable thereto;

an extension panel operably connected to the shade for translation therewith;

a pair of lead carriers each translatably secured to one of the tracks; and a pair of deployment members each connected to the extension panel and to one of the lead carriers, each of the deployment members being movable with respect to the associated lead carrier and adapted to lift extension panel with respect to the lead carrier into a deployed position such that at least a portion of the extension panel extends beyond the end of the tracks.

17. The window covering system according to claim 16, wherein each of the deployment members includes an elongated arm pivotably connected to the associated lead carrier at a pivot axis.

18. The window covering system according to claim 16 wherein each of the lead carriers includes a pair of spaced cars each having at least one roller member rotatably supported by the car and adapted for engagement with a notch formed in one of the tracks, each of the lead carriers further including a mount member secured to the cars such that the cars are located adjacent opposite first and second ends of the mount member.

19. The window covering system according to claim 17 further comprising at least one drive cable secured to the deployment member for translation of the shade panels with respect to the tracks and for pivot of the deployment members with respect to the lead carriers.

20. The window covering system according to claim 19 further comprising a drive cable guide assembly including a pulley rotatably supported by a pulley support member and adapted for receipt of the drive cable, the pulley support member being secured to the associated lead carrier.

21. A window shade apparatus comprising:

a pair of spaced tracks having opposite ends;

a shade including a plurality of panels arranged end-to-end, the panels translatably connected to the tracks for movement between a fully-retracted position and a fully-extended position;

an extension panel connected to a terminal one of the shade panels; and an extension panel deployment assembly including a pair of mount members each translatably connected to one of the tracks, the extension panel deployment assembly adapted to lift the extension panel with respect to the mount members into a deployed position from a retracted position such that at least a portion of the extension panel extends beyond one of the ends of the tracks, the extension panel and the terminal one of the shade panels oriented substantially parallel to each other when the extension panel is in its deployed position and the shade is in its fully-extended position.

* * * * *